US009661971B2

(12) United States Patent
Riehl

(10) Patent No.: US 9,661,971 B2
(45) Date of Patent: May 30, 2017

(54) VACUUM-CLEANING ROBOT

(71) Applicant: Klaus-Dieter Riehl, Drolshagen (DE)

(72) Inventor: Klaus-Dieter Riehl, Drolshagen (DE)

(73) Assignee: WESSEL-WERK GMBH, Reichshof-Wilbergerhuette (DE)

( * ) Notice: Subject to any disclaimer, the term of this patent is extended or adjusted under 35 U.S.C. 154(b) by 403 days.

(21) Appl. No.: 14/473,487

(22) Filed: Aug. 29, 2014

(65) Prior Publication Data

US 2015/0059120 A1 Mar. 5, 2015

(30) Foreign Application Priority Data

Aug. 30, 2013 (DE) ..... 10 2013 109 498

(51) Int. Cl.

| | |
|---|---|
| ***A47L 9/02*** | (2006.01) |
| ***A47L 9/28*** | (2006.01) |
| ***A47L 9/00*** | (2006.01) |
| ***A47L 9/08*** | (2006.01) |
| ***A47L 9/04*** | (2006.01) |
| ***A47L 11/40*** | (2006.01) |
| *A47L 9/06* | (2006.01) |

(52) U.S. Cl.

CPC ..... *A47L 9/2852* (2013.01); *A47L 9/009* (2013.01); *A47L 9/0494* (2013.01); *A47L 9/06* (2013.01); *A47L 9/08* (2013.01); *A47L 11/4058* (2013.01); *A47L 9/066* (2013.01); *A47L 9/0666* (2013.01); *A47L 2201/00* (2013.01)

(58) Field of Classification Search

CPC .. A47L 9/2852; A47L 9/0494; A47L 11/4058; A47L 9/009; A47L 9/06; A47L 9/08; A47L 9/066; A47L 9/0666; A47L 2201/00

IPC ..... A47L 9/02

See application file for complete search history.

(56) References Cited

U.S. PATENT DOCUMENTS

| | | | | |
|---|---|---|---|---|
| 6,581,239 | B1 * | 6/2003 | Dyson | A47L 5/34 15/340.3 |
| 2005/0015912 | A1 * | 1/2005 | Kim | A47L 5/34 15/319 |
| 2005/0076466 | A1 * | 4/2005 | Yan | A47L 5/28 15/319 |

* cited by examiner

*Primary Examiner* — David Redding
(74) *Attorney, Agent, or Firm* — Andrew Wilford

(57) ABSTRACT

A self-propelled vacuum cleaner has a main housing having a bottom wall formed with an aperture, floor-engaging wheels on the main housing, and a drive in the main housing for rotating the wheels and advancing the main housing in a normal horizontal travel direction. A module housing projecting through the aperture forms a brush compartment defining a downward directed suction opening having relative to the direction a leading edge and a trailing edge. The module housing is supported in the main housing for limited vertical movement of the module housing relative to the main housing. A brush in the module housing is engageable through the opening with a floor beneath the opening, and a blower in the module housing having an intake connected via a duct to the brush compartment for aspirating air through the opening and past the brush into the module housing.

9 Claims, 3 Drawing Sheets

22

VACUUM-CLEANING ROBOT

FIELD OF THE INVENTION

The present invention relates to self-propelled vacuum cleaner. More particularly this invention concerns vacuum-cleaning robot.

BACKGROUND OF THE INVENTION

A typical vacuum robot comprises a main housing and a drive with at least two power-driven wheels. A vacuum blower, a duct connected to the vacuum side of the blower to guide air and separate out dirt and a power source to supply power are provided in the main housing.

The drive of the vacuum robot has a preferred travel direction in which the vacuum cleaner is moved by the high velocity power wheels. Cornering is effected using different rotation speeds of the drive wheels. Turning in place with counter-rotating wheels is also possible.

So that the vacuum robot can move autonomously in the room to be cleaned, it has a navigation system, typically operating under GPS or odometric protocols. Often the distance traveled is inferred from the movement data from the drive. Slip of the drive wheels—especially if this occurs unevenly—can massively reduce the accuracy of the navigation. Here the frictional resistance that occurs between the underside of the vacuum robot and the floor surface to be cleaned is of a decisive magnitude for the occurrence and distribution of slip of the drive wheels. The drive and navigation systems of vacuum robots are widely developed in the prior art.

Previously however the suction characteristics and the suction-opening design of a vacuum robot were not adequately addressed. As a result the current vacuum robot models are still far behind the technically possible suction performance.

Against this background the object of the invention is to provide a self-propelled vacuum cleaner with improved suction characteristics and at the same time more precise navigation. In this case getting over obstacles must also be considered.

OBJECTS OF THE INVENTION

It is therefore an object of the present invention to provide an improved self-propelled vacuum cleaner.

Another object is the provision of such an improved self-propelled vacuum cleaner that overcomes the above-given disadvantages, in particular that moves well on different floor types, from smooth to high-pile carpet, and that also is capable of automatically adjusting for best vacuuming on all floor types.

SUMMARY OF THE INVENTION

A self-propelled vacuum cleaner has according to the invention a main housing having a bottom wall formed with an aperture, floor-engaging wheels on the main housing, and a drive in the main housing for rotating the wheels and advancing the main housing in a normal horizontal travel direction. A module housing projecting through the aperture forms a brush compartment defining a downward directed suction opening having relative to the direction a leading edge and a trailing edge. The module housing is supported in the main housing for limited vertical movement of the module housing relative to the main housing. A brush in the module housing is engageable through the opening with a floor beneath the opening, and a blower in the module housing having an intake connected via a duct to the brush compartment for aspirating air through the opening and past the brush into the module housing. An angled slide face at least 10 mm high is provided at the leading edge, and a flexible lip extends downward from the module housing rearward in the direction from the trailing edge.

Thus the vacuum-cleaning tool is a preassembled module and is not an integral part of the main housing of the vacuum robot, but rather is a preassembled module attached to it. Thus, it is possible with a vacuum robot model that has already been optimized with regard to navigation, drive, and suction power performance, to increase suction performance by using an optimized preassembled module and a cleaning tool by a specialized manufacturer. The individual elements of the vacuum-cleaning tool are coordinated to achieve the best possible suction result. For different requirement profiles—for example with different dirt types—certain specific elements can be combined with each other. For the suction characteristics in general the design of the front suction-opening edge is decisive. Because of the rigid design of the front suction-opening edge especially good suction power is achieved. In this connection "rigid" means that the shape of the suction-opening edge does not change when used as intended beyond the range of manufacturing tolerances. So that obstacles can be gotten over, forward in the travel direction of the bottom opening on the roller chamber there is an angled slide of at least 10 mm. The reference point for this height is a smooth floor where the vacuum cleaner rests. Preferably the height of the angled slide should be about 15 mm. With an angled slide a steady profile is meant with a pitch angle of preferably not more than 45°. Finally with the combination of a rotationally driven cleaning roller and the aspiration of airflow from inside the roller chamber further improvement in the cleaning action can be achieved, without generating additional friction on the ground through excessively strong suction airflow that could impair navigation of the vacuum robot.

There are numerous possibilities for the structural design of the angled slide. The angled slide can comprise a rigid sliding surface on the bottom wall of the support. Further forward of the suction-opening edge there can be a pivotable flap or a flexible lip that curves away to create the angled slide. Finally, the angled slide can be made from an arrangement of ribs and/or ridges, whereby also especially bow-shaped sliding elements and runners are covered by the term "ridges."

In a preferred embodiment the vacuum-cleaning tool is arranged vertically movably or pivotally mounted on the main housing and has rollers for bottom side support. In this manner the suction-cleaning tool is separate from the weight of the other element of the robot, namely the main housing with drive, blower, power supply, and air guide and dirt separator. The pivotal or spring mounting of the suction cleaning tool on the main housing ensures that the suction cleaning tool be deflected upward when the vacuum robot is used with a high-pile floor covering and the robot main housing as a result of its weight sinks somewhat deeply into the pile. The vertical movability or pivotability allows the suction-cleaning tool to always conform to varying floor irregularities. The suction cleaning tool can be supported on the main housing via springs. In addition the suction-cleaning tool can be provided with rollers or floor slides to ensure that the leading suction-opening mouth during vacuuming of a smooth floor maintains a defined spacing of preferably 1 to 2 mm from the floor surface.

The back edge of the bottom-wall opening of the vacuum-cleaning tool in the travel direction is preferably formed as a rigid suction-opening edge. The flexible lip arranged in the back then is only for additional sealing of the vacuum-cleaning tool toward the back. But it is within the scope of the invention that the flexible lip in the travel direction behind the bottom-wall opening creates a suction-opening edge bordering the bottom-wall opening.

The roller chamber can be fixedly attached to the bottom surface of the suction-cleaning tool. Advantageously the roller chamber is pivotally mounted to the main housing of the suction cleaning tool and on the support bottom wall has integral suction-opening edges. In this embodiment the suction-opening edges are connected directly to the outer wall of the roller chamber. In this way the pivot axis of the roller chamber is preferably aligned with the axis of rotation of the cleaning roller.

In a further advantageous embodiment the suction-opening edges are individually or as a preassembled module vertically movable together. The cleaning roller can be equipped with brushes that extend helically along the outer surface of the cleaning roller. This arrangement can especially consist of two symmetrically oppositely arranged embodied screws, so that lateral torque due to the operation of the cleaning roller is eliminated. Depending on the floor covering and the specific use the cleaning roller can also have soft pads for example of plush, felt or foam. Further the cleaning roller can be equipped with elastic lips, which may also have a helical shape.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
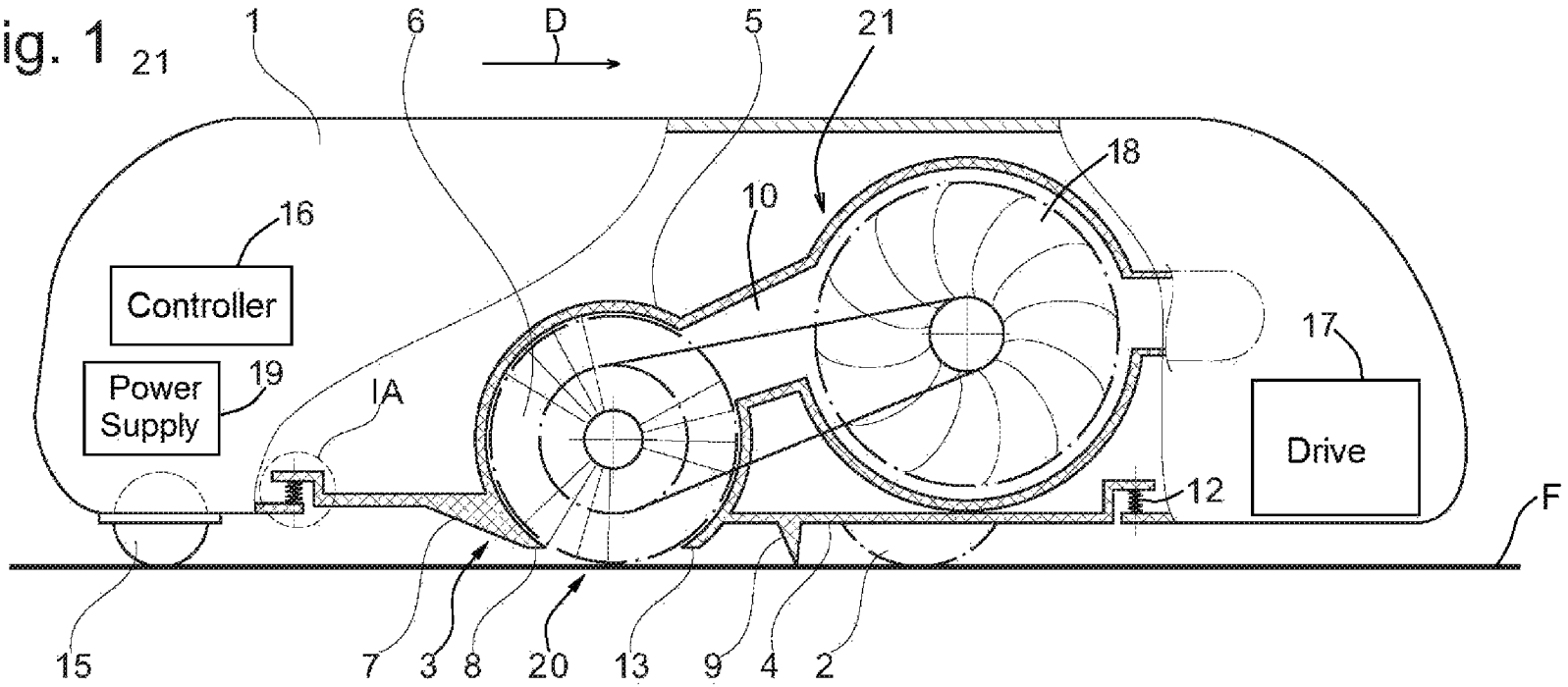
FIG. 1 is a schematic side view partly in section of a self-propelled vacuum cleaner.

As seen in FIG. 1 a vacuum-cleaning robot according to the invention has a main housing 1, typically of injection-molded plastic holding a schematically illustrated controller 16 and drive 17, as well as a battery serving as power supply 19, antennas, and such.

The generally planar rigid bottom wall of the main housing 1 carries two coaxial drive wheels 2 that are rotated by the drive 17 and that can be differentially rotated to steer the device. A ball-type caster 16 at the front end of the main housing bottom wall provides the third point of support, making the main housing 1 stable even on an uneven floor surface F.

The main housing also holds a blower 18, structure including a duct 10 connected to the suction side of the blower 18 for drawing in air and separating dirt. The design of such a vacuum cleaner, which is also called a vacuum robot, has been known for a long time. The weight of the basic body of the vacuum robot is borne by the two driven wheels 2 and the support caster 15. Instead of a caster, this support can a slide.

On the underside of the self-propelled vacuum cleaner there is a modular suction cleaning tool 3 that according to the invention includes a cylindrical roller chamber 5 holding a standard driven brush 6 and open downward at an elongated mouth opening 20 having parallel leading and trailing edges 8 and 13 extending perpendicular to a standard travel direction D. The leading edge 3 is formed by a thickened portion of the planar floor or bottom wall of the one-piece injected module housing 21 of the module 3, and having a lower face 7 that is planar and angled downward and back so as to form a smooth and gentle ramp. This angled face 7 is 10 mm high and forms an angle of at most 45° to the horizontal.

Figure 1A:
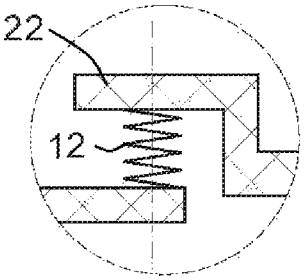
FIG. 1A is a detail view of the structure indicated at IA in FIG. 1.

The leading and trailing edges 8 and 13 are at the same level and lie below the plane of the floor of the module housing 21. In addition as shown in FIG. 1A, the periphery of the bottom wall of the module housing 21 has raised edges 22 that are supported on top of the bottom wall of the main housing 1 by compression springs 12 that allow the entire module 3 to be deflected upward into the housing 1.

Rearward of the trailing edge 13 of the opening 20 is a downwardly projecting transverse lip 9 that is normally flexible and that primarily serves to prevent excessive air being drawn into the opening 20 by the blower 3 from behind.

The wheels 2 and support caster 15 hold the main housing 1 at such a height that it can easily clear any irregularities in the floor F that are likely to be encountered. The mouth 20, however, opens at a significantly lower level set to be ideal for vacuuming a smooth floor, for instance of wood or tile and about 1-2 mm. If, however, the floor has, for example, a high pile, this will push the entire module 3 up into the housing 1, resetting the level of the mouth 20 where it is needed for vacuuming such a surface. Because of the vertically movable or pivotally movable mounting of the module 3, it automatically adjusts to floor conditions. It also ensures that the front suction-opening edge 8 during suctioning of smooth surfaces maintains a specified distance of preferably 1 to 2 mm from the floor.

The vertically movable or pivotal support of the suction-cleaning tool is decoupled from the weight of the basic robot body. This ensures that the preassembled suction-cleaning module 3 moves upward freely or against a spring force when the vacuum robot for example is used on a high-pile floor covering and the basic robot body sinks relatively deeply into the pile because of its weight.

The angled slide 7 in the embodiment is a rigid sliding surface on the planar bottom wall 4 of the module housing 21. In place of the sliding surface illustrated in FIGS. 1 and 2 the angled slide 4 can be formed by an array of ribs and/or ridges. The back edge 13 of the bottom-wall opening of the vacuum-cleaning tool is rigid. The flexible lip 9 mounted in the back then is only for additional sealing of the suction-cleaning tool 3 in the back.

Figure 2:
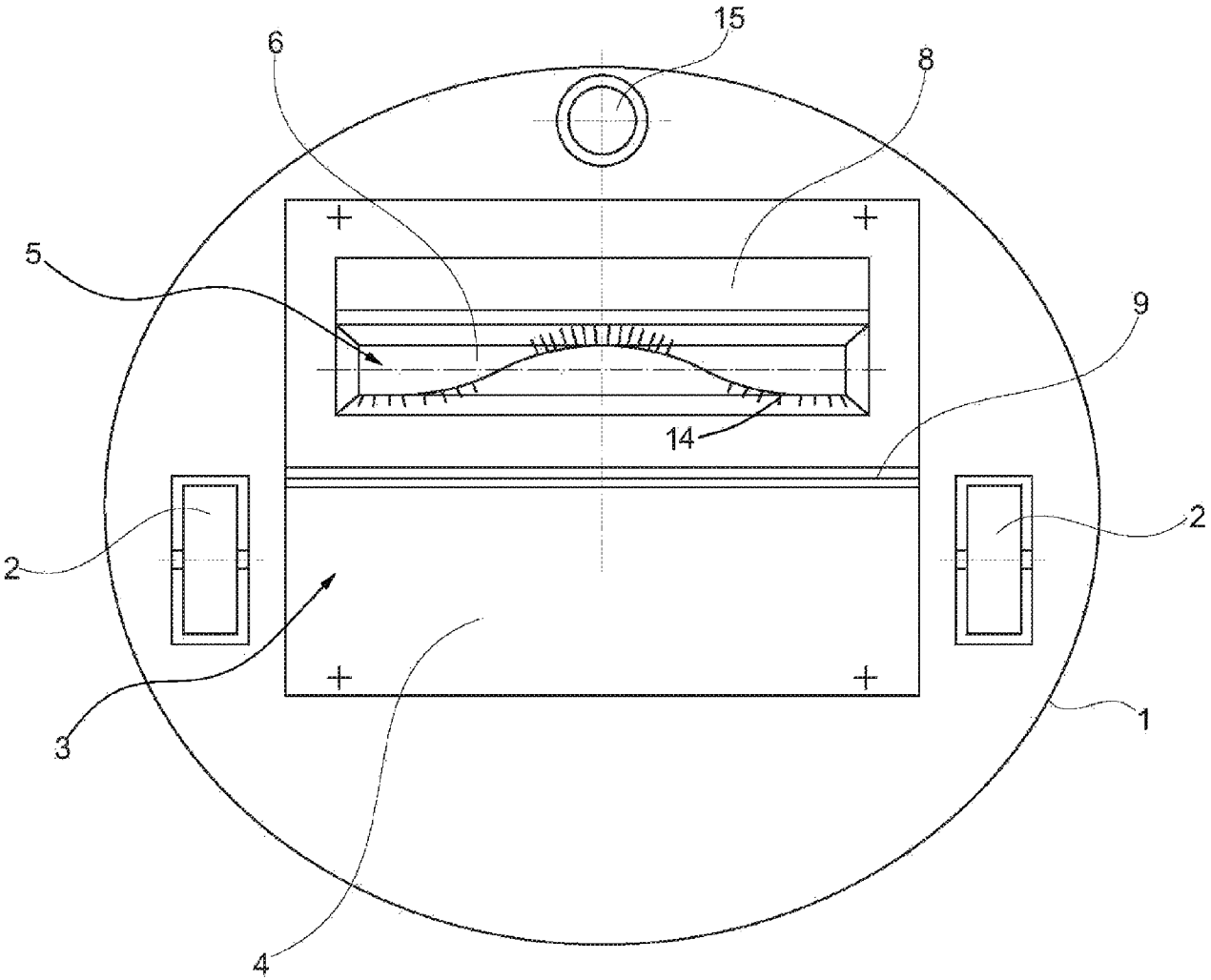
FIG. 2 is a schematic bottom view of the vacuum cleaner of FIG. 1.

The cleaning roller 6 can be equipped with brushes 14 (FIG. 2 only or elastic lips that are helically arranged along the circumference of the cleaning roller. Independent of the flooring and the specific application the cleaning roller can also have soft pads, for example made from plush, felt or foam.

Figure 3:
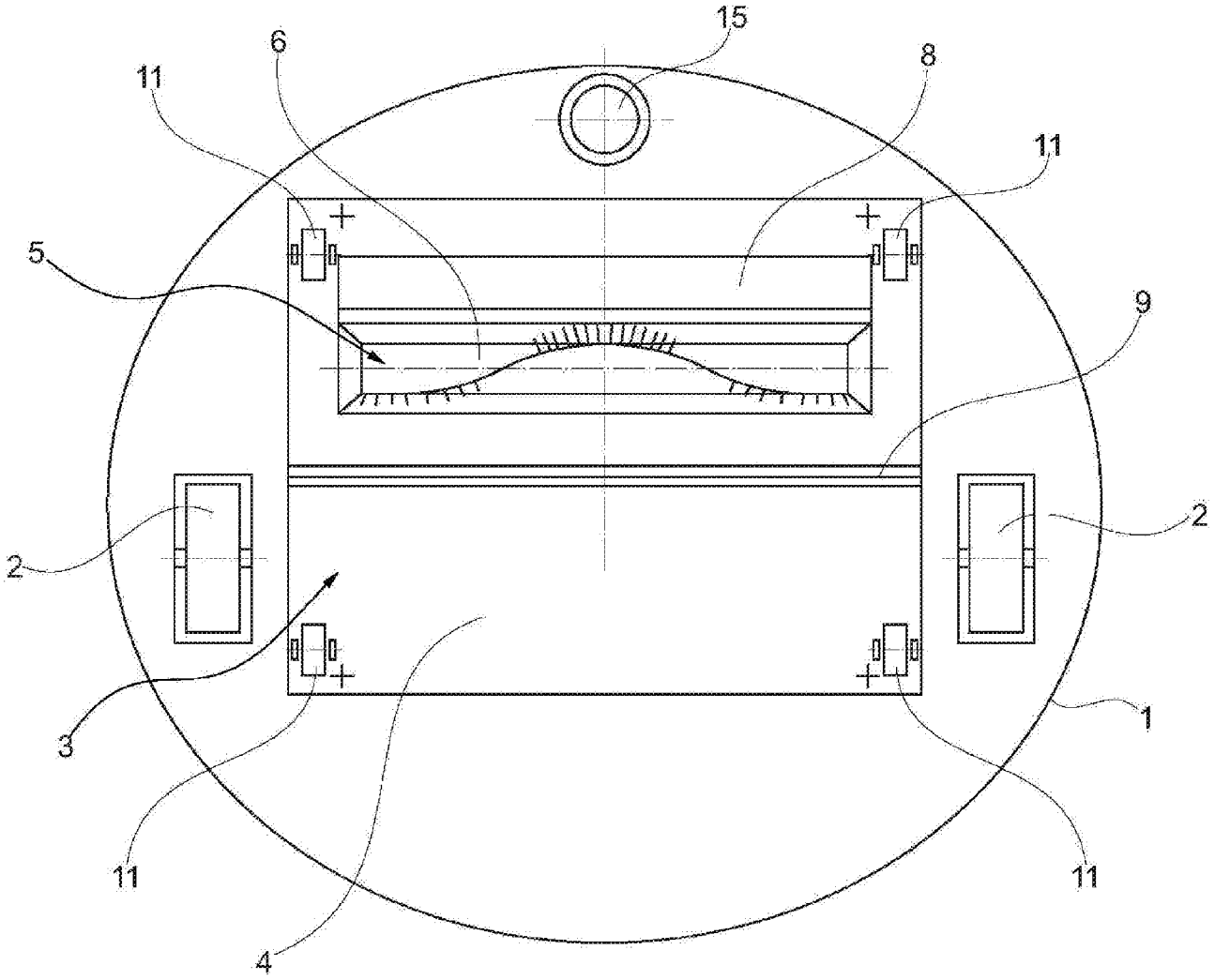
FIG. 3 is a schematic bottom view of a further embodiment of the vacuum cleaner.

In the embodiment of FIG. 3, the main housing 1 has a vertically movable or pivotal suction-cleaning tool 3 provided with rollers 11 that support it on the floor F. The rollers 11 ensure that the leading suction-opening edge 8 during vacuuming of a smooth floor maintains a defined spacing of preferably 1 to 2 mm from the floor surface. Instead of the rollers 11 other floor slides, ball-type rollers, or wheels that automatically align with the travel direction of the robot can be used.

I claim:

1. A self-propelled vacuum cleaner comprising:

a main housing having a bottom wall formed with an aperture;

floor-engaging wheels on the main housing rotatable for advancing the main housing in a normal horizontal travel direction;

a module housing projecting through the aperture and forming a brush compartment defining a downward directed suction opening having relative to the direction a leading edge and a trailing edge, the module housing being limitedly vertically movable in the main housing relative to the main housing;

a brush in the module housing engageable through the opening with a floor beneath the opening;

a blower in the module housing having an intake;

a duct connecting the intake to the brush compartment for aspirating air through the opening and past the brush into the module housing;

structure forming an angled slide face at least 10 mm high at the leading edge; and a flexible lip extending downward from the module housing rearward in the direction from the trailing edge.

2. The self-propelled vacuum cleaner defined in claim 1, further comprising:

springs supporting the module housing on the main housing.

3. The self-propelled vacuum cleaner defined in claim 1, further comprising:

rollers or slides supporting the module housing on the floor.

4. The self-propelled vacuum cleaner defined in claim 1, wherein the module housing has a rigid bottom wall and the angled slide is unitarily formed on a thickened region of the bottom wall at the leading edge.

5. The self-propelled vacuum cleaner defined in claim 1, wherein the angled slide face forms a substantially planar ramp extending downward and rearward from the module housing relative to the travel direction.

6. The self-propelled vacuum cleaner defined in claim 1, wherein the slide face is made from an array of ribs and/or ridges.

7. The self-propelled vacuum cleaner defined in claim 1, wherein the trailing edge is formed as a ridged edge.

8. The self-propelled vacuum cleaner defined in claim 1, wherein the roller chamber is pivotally mounted and the suction-opening edge is molded on a bottom wall of the module housing.

9. The self-propelled vacuum cleaner defined in claim 8 wherein a pivot axis of the roller chamber is flush with a rotation axis of the cleaning roller.

* * * * *